US007129925B2

(12) United States Patent
Schloeman et al.

(10) Patent No.: US 7,129,925 B2
(45) Date of Patent: Oct. 31, 2006

(54) DYNAMIC SELF-REFRESH DISPLAY MEMORY

(75) Inventors: Dennis J. Schloeman, Corvallis, OR (US); Eugene J Mar, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 361 days.

(21) Appl. No.: 10/423,517

(22) Filed: Apr. 24, 2003

(65) Prior Publication Data

US 2004/0212576 A1 Oct. 28, 2004

(51) Int. Cl.
*G09G 3/34* (2006.01)

(52) U.S. Cl. ..... 345/108

(58) Field of Classification Search ..... 345/84, 345/98–100, 108, 204–206
See application file for complete search history.

(56) References Cited

U.S. PATENT DOCUMENTS 4,910,708 A * 3/1990 Eaton et al. ..... 365/145
5,079,544 A * 1/1992 DeMond et al. ..... 345/84
5,285,407 A * 2/1994 Gale et al. ..... 365/189.11
5,307,056 A 4/1994 Urbanus
5,442,588 A 8/1995 Runas
5,519,450 A 5/1996 Urbanus et al.
5,612,713 A 3/1997 Bhuva et al.
5,670,977 A 9/1997 Chiu et al.
5,677,703 A 10/1997 Bhuva et al.
5,686,939 A * 11/1997 Millward et al. ..... 345/84
5,751,264 A 5/1998 Cavallerano et al.
6,175,351 B1 * 1/2001 Matsuura et al. ..... 345/98
6,191,883 B1 2/2001 Huffman et al.
6,300,924 B1 10/2001 Markandey et al.
6,349,065 B1 2/2002 Ooishi
6,812,669 B1 * 11/2004 Hagen ..... 318/629
6,865,100 B1 * 3/2005 Wald et al. ..... 365/94
6,937,222 B1 * 8/2005 Numao ..... 345/98
2002/0036611 A1 3/2002 Ishii
2002/0085437 A1 7/2002 Coleman, Jr. et al.
2002/0097136 A1 7/2002 Huffman et al.

OTHER PUBLICATIONS

David A. Jared et al., "Electrically addressed spatial light modulator that uses a dynamic memory" Optics Letters V. 16 No. 22 (Nov. 15, 1991), pp. 1785-1787.

* cited by examiner

*Primary Examiner*—Amr A. Awad
*Assistant Examiner*—Tom Sheng

(57) ABSTRACT

A dynamic memory cell for storing data in a display having at least one MEMS device for each pixel has at least two dynamic memory elements per pixel, including first and second dynamic memory elements, each including at least one capacitor, both of the first and second memory elements being electrically coupled to the MEMS device of a single pixel. A sense amplifier is configured to amplify the data signal and to latch data in response to a differential data signal and a clock signal, self-refreshing the data and loading data to the MEMS device as required.

33 Claims, 2 Drawing Sheets

DYNAMIC SELF-REFRESH DISPLAY MEMORY

TECHNICAL FIELD

This invention relates to display memories and more particularly to a dynamic memory for storing data in a display having at least one MEMS device for each pixel.

BACKGROUND

Displays and light-projectors using arrays of MEMS devices such as the micromirrors of Digital Micromirror Devices™ (DMD's) have been developed for a number of applications. ("Digital Micromirror Device™" is a trademark of Texas Instruments.) For some applications, DMD's include a static random-access memory (SRAM) for storing image data and addressing the array of micromirrors. Thus, the DMD SRAM's have used memory cells having a single static memory cell per pixel. Typically, each mirror in an array of mirrors is suspended above an individual SRAM cell in a corresponding array of memory cells. Address electrodes are connected to the SRAM nodes at which "1" or "0" voltages are set.

Electrostatic forces applied between the address electrodes and the mirrors rotate the mirrors about an axis. The rotation is stopped at predetermined angles, limited by touching of an edge of the mirror at the substrate. Gray scale in images is accomplished by using pulse width modulation of the binary ON (1) and OFF (0) times of each mirror. Such digital operation of DMD's and other MEMS-based display arrays imposes bandwidth requirements on the display's circuitry for filling the array with data for each frame to be displayed.

Some DMD displays take advantage of mechanical latching of the mirrors and some DMD displays utilize architectures having SRAM's smaller than the micromirror array, in the sense of having a number of SRAM cells that is a fraction of the number of micromirrors in the micromirror array. In such architectures, the peak data rate can be made comparable to the average data rate. As faster and larger arrays of MEMS devices are developed for displays and other applications, further reduction of bandwidth is a very desirable goal, especially if it can be achieved in a way that does not depend on particular physical characteristics of the MEMS devices in the array.

BRIEF DESCRIPTION OF THE DRAWINGS

The features and advantages of the invention will be readily appreciated by persons skilled in the art from the following detailed description when read in conjunction with the drawings, wherein.

DETAILED DESCRIPTION OF EMBODIMENTS

Figure 1:
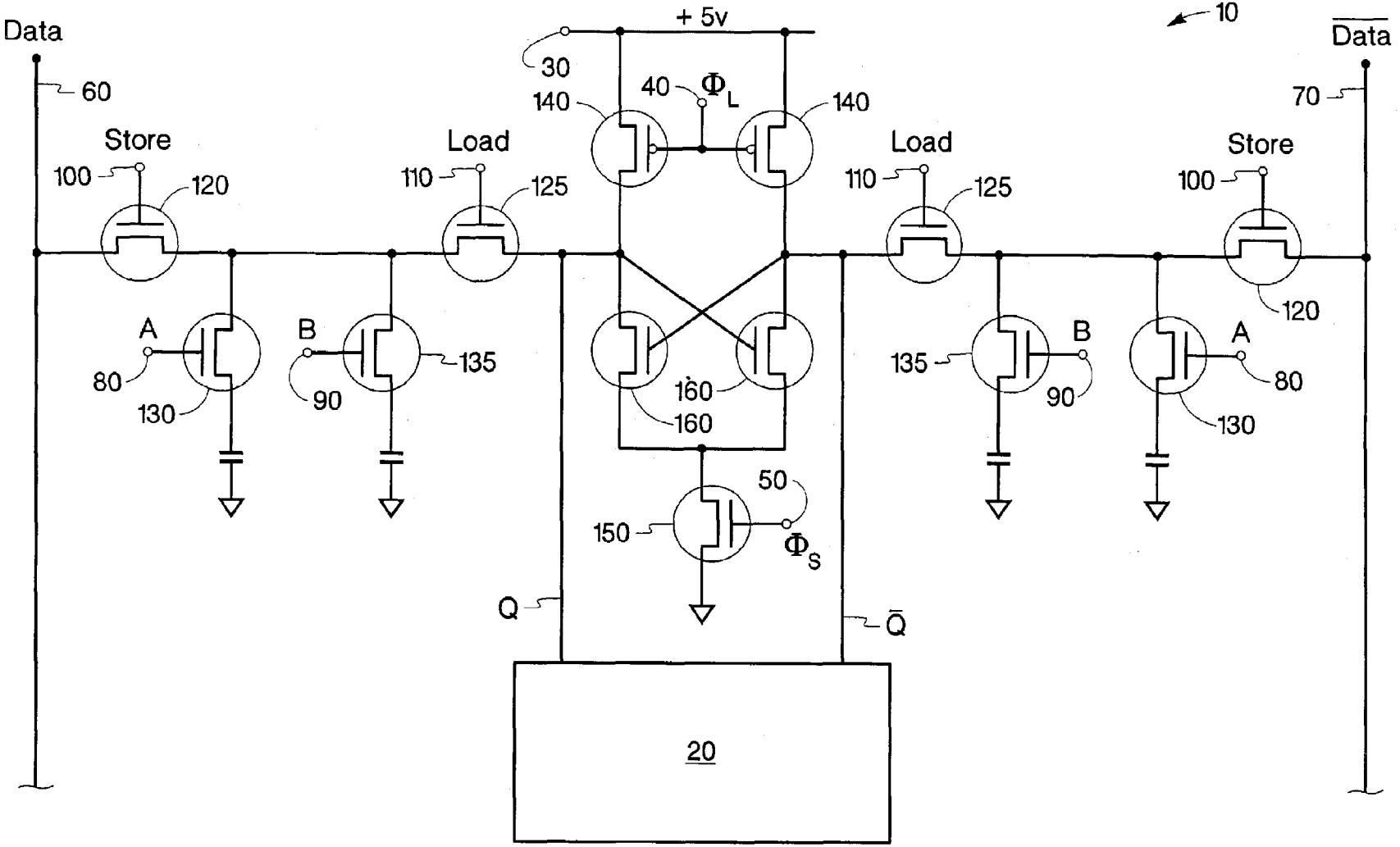
FIG. 1 is a schematic diagram of an embodiment of a memory cell made in accordance with the invention.

For clarity, the following detailed description focuses on a particular simple embodiment of a dynamic self-refreshing memory cell for a MEMS device of an array of MEMS devices. Those skilled in the art will recognize that the invention may be readily implemented in other similar embodiments. For specificity, the MEMS device with which the invention is used may be considered to be a digital micromirror device (DMD), but the invention may be applied to any kind of MEMS device and to an array of any kind of MEMS devices.

Throughout this specification and the appended claims, the term "MEMS" has its conventional meaning of a micro-electro-mechanical system. Where particular devices are designated as "P-channel" or "N-channel," etc. for specificity of the description of a particular example embodiment, those skilled in the art will recognize that bipolar devices or other combinations of device types may be used with appropriate signals.

Embodiments made in accordance with the present invention have a dynamic memory cell for storing data in a display having at least one MEMS device for each pixel. The dynamic memory cell has at least two dynamic memory elements per pixel, including first and second dynamic memory elements, each including at least one capacitor for storing charge. Both of the first and second memory elements are electrically coupled to the MEMS device of a single pixel. A sense amplifier is configured to amplify the data signal and to latch data in response to a differential data signal and a clock signal, self-refreshing the data and loading data to the MEMS device as required. The same sense amplifier may be used to read the data stored (e.g., for testing), as is discussed in more detail hereinbelow.

Other embodiments made in accordance with the present invention have a number N of dynamic memory elements per pixel, where N is greater than two. Embodiments with exactly two dynamic memory elements per pixel reduce the data bandwidth by a factor of two. Those skilled in the art will recognize that, similarly, embodiments with N dynamic memory elements per pixel can reduce the data bandwidth by about a factor of $2^{(N-1)}$. It is convenient for many such applications to make N an even number. Of course, larger values of the number N require larger numbers of transistors or other active devices, and there are costs associated with the additional active devices, including fabrication costs, yield-related costs, and reliability-related costs. Thus, in practical applications there are tradeoffs among bandwidth reduction, device fabrication costs, and various other cost factors which are familiar to those skilled in the art.

The memory for a display device has a number of memory cells, at least one memory cell for each pixel of the display. The memory cell or an entire array of memory cells may be incorporated into an integrated circuit, may be incorporated on a substrate carrying microelectronics, and may be incorporated into an electronic device.

Figure 2:
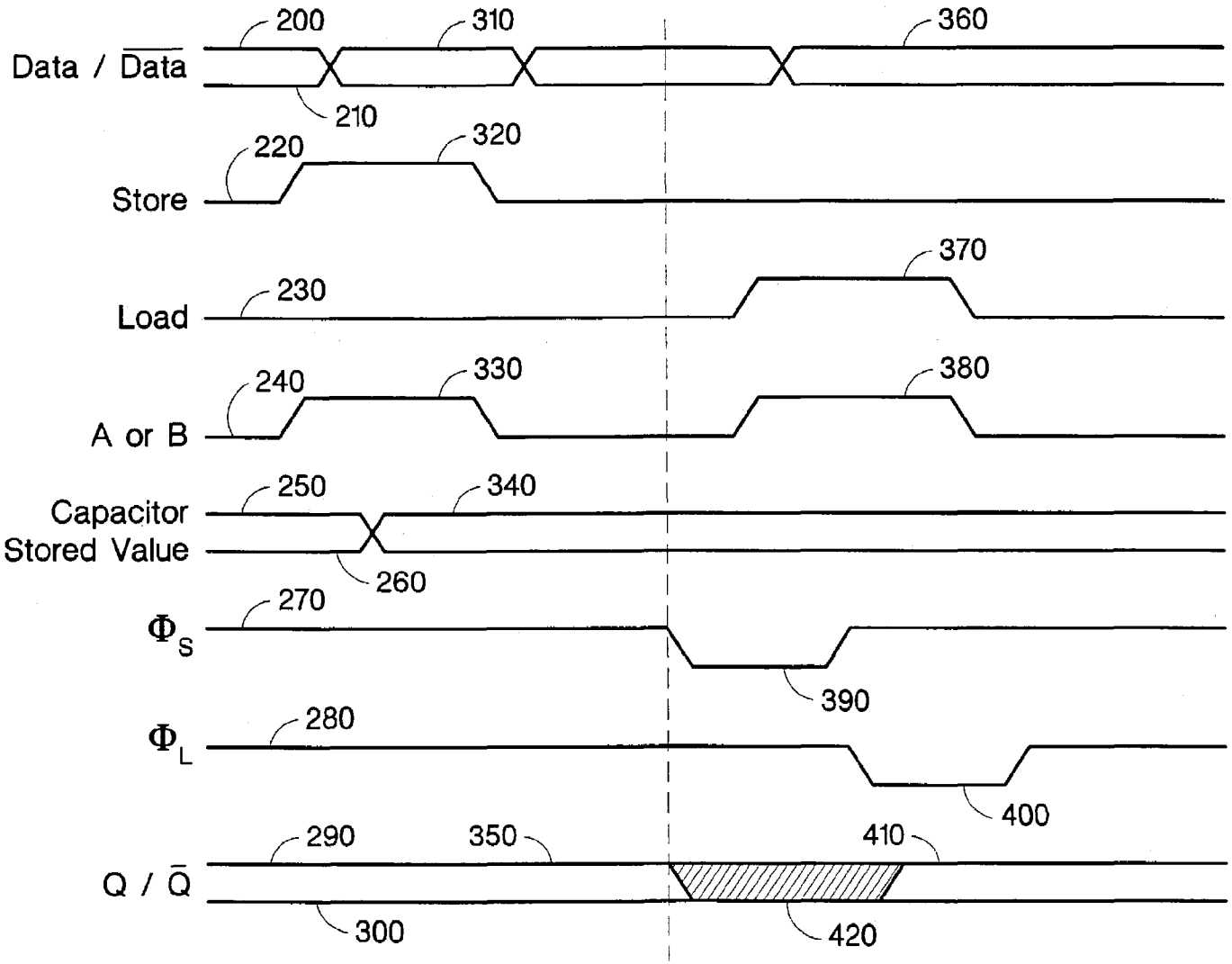
FIG. 2 is a timing diagram of the memory cell embodiment shown in FIG. 1.

FIG. 1 shows a schematic diagram of a simple embodiment of a memory cell 10 made in accordance with the invention. A representative timing diagram of the memory cell embodiment of FIG. 1 is shown in FIG. 2. The schematic diagram shows a two-memory-element dynamic memory cell with thirteen transistors and four capacitors driving a MEMS device 20 for a single pixel of a display or of an array of other MEMS devices.

Memory cell 10 may be used in a display of the type having at least one MEMS device 20 corresponding to each pixel. It will be understood that MEMS device 20 may be more complex than a simple micromirror and may, in fact, comprise more than one MEMS device, but for purposes of understanding the embodiment illustrated in FIGS. 1 and 2, MEMS device 20 may be considered to be a simple MEMS micromirror.

Memory cell 10 is used for storing data in response to a data signal provided as a differential signal including true and complementary data lines (true signal 60 and its complementary signal 70) and a clock signal 50 ($\phi_S$). This particular embodiment has exactly two dynamic memory elements per pixel. Each of the two dynamic memory elements has a capacitor for charge storage. (In FIG. 1, the capacitors are designated as A or B capacitors, corresponding to the designation at the gates 80 or 90 of their associated transistors 130.) Both of the two dynamic memory elements are electrically coupled to the MEMS device 20 of a single pixel, as shown in FIG. 1. A sense amplifier (defined by devices 140, 150, and 160 as described hereinbelow) is configured to amplify the data signal and to latch data in response to the data signals 60 and 70 as timed by clock signal 50. For illustrative purposes, VDD power supply line 30 is shown in FIG. 1 as supplying +5V; that supply voltage is chosen to be suitable for the application and for the active device types used.

One of the problems with implementing a dynamic memory approach is refreshing the charge-storage capacitors in the memory cells. The same sense amplifier for each pixel is used to refresh the local charge-storage elements. Thus, the dynamic memory cell 10 of FIG. 1 is a self-refreshing memory cell. Reading of the stored data does not have to be fast, since reading is required for test purposes only. For read operations, the sense amplifier is also used to drive the read data on the bit lines.

In the sense amplifier, P-channel device 140 is enabled when $\phi_L$ is asserted low. Device 140 allows signals Q and /Q (shown in the drawings with an overbar) to be attached to VDD through high impedance loads in order to amplify the Q and /Q signal value. Amplification can occur only after one of two storage capacitors is enabled by either device 130 or 135 and devices 125 and 150 are also enabled. N-channel device 150 is enabled when $\phi_S$ is asserted high. Device 150 allows a signal path to ground for cross-coupled devices 160 so that Q and /Q can be amplified when device 140 is enabled. N-channel devices 160 form the cross-coupled devices of the sense amplifier. Devices 160 are used for positive feedback of signals on Q and /Q so that those signals can be amplified when device 150 is enabled first and then device 140 is enabled second.

The dynamic memory cell with two memory elements per pixel requires at least two capacitors and requires fewer transistors than an SRAM memory cell would require. (A static SRAM approach with two memory elements per pixel would require about twenty transistors.) The dynamic memory cell has one sense amplifier per pixel to latch the appropriate input data and to amplify the data signal to an amplitude voltage suitable for actuating the MEMS device. If the MEMS device is a micromirror, for example, the voltage level from the sense amplifier is suitable for actuating a micro-mirror device. For simplicity, it is assumed in this description that the MEMS device holds a binary value loaded into it for at least a suitable predetermined time after the value is loaded.

The following description will be more readily understood by reference to the timing diagram in FIG. 2 in conjunction with the schematic diagram of FIG. 1. In FIG. 1, the charge-storage capacitors are identified as A or B capacitors by the reference letter A or B shown at the gate of each corresponding FET device 130 or 135 respectively. The bit line of the memory consists of a conventional complementary signal pair, DATA and its complement /DATA (shown in the drawings with an overbar), represented by vertical lines 60 and 70 in FIG. 1. As indicated at the lower ends of the DATA and /DATA lines in FIG. 1, these may extend to other memory cells of an array. Other elements in FIG. 1 are described in more detail below.

In the timing diagram, FIG. 2, the vertical dashed line divides the time to distinguish the STORE portion (left) from the LOAD portion (right). FIG. 2 shows the DATA and /DATA signals (200 and 210 respectively) and their values 310 and 360 at different times, the STORE signal 220 and its value 320 when asserted, the LOAD signal 230 and its value 370 when asserted, the A or B selection signal 240 and its values 330 for a STORE operation and 380 for a LOAD operation, the capacitor stored values 250 and 260 with representative value 340, STORE clock signal $\phi_S$ (270) and its value 390 at a certain time, and LOAD clock signal $\phi_L$ (280) and its value 400 at a later time. FIG. 2 also shows the MEMS-device value Q (290) and its value 350 at a particular time before loading a new value into the MEMS device 20, and FIG. 2 shows its complement /Q (300) and the value 410 of /Q at another time after loading the new value into the MEMS device 20. Reference numeral 420 denotes a transition time interval during which the values of Q and /Q are indeterminate.

N-channel FET devices 120 are enabled when the STORE signal is asserted high. Devices 120 allow storage of the value of DATA and its complement /DATA when either the A or B capacitor select signal is asserted high. Storing a pixel value is done by asserting the STORE signal 220 at a high value and by also selecting 330 either the A or B storage capacitors with gates 80 or 90 (line 240 in FIG. 2). The bit line is driven differentially with DATA 200 and complementary /DATA 210 values, and the corresponding data value is stored into one of selected capacitors (A or B) on either side. Devices 120 also allow reading of stored charge on a selected one of the two capacitor storage cells after the stored charge is loaded into the sense amplifier. Reading is then done by enabling device 125 and either device 130 or 135, and then enabling device 120 after the sense amplifier has amplified the storage-node charge signal. N-channel FET devices 125 are enabled when LOAD signal 230 (terminals 110 in FIG. 1) is asserted high.

N-channel FET device 130 is enabled when signal A is asserted high. Device 130 allows signals on DATA and /DATA to be stored on the respective capacitors when device 120 is also enabled at the same time. Device 130 also allows the storage capacitor value to be amplified and refreshed when devices 125 and 130 are enabled.

N-channel FET device 135 is enabled when signal B is asserted high. Device 135 allows signals on DATA and /DATA to be stored on the respective capacitors when device 120 is also enabled at the same time. Device 135 also allows storage capacitor value to be amplified and refreshed by the sense amplifier when devices 125 and 135 are enabled.

Loading the stored memory elements in the MEMS latch is done by first de-asserting the two sense-amplifier clock signals 270 ($\phi_S$) and 280 ($\phi_L$), asserting the LOAD signal 230 at a high value, and selecting one of two stored values: A or B (330).

N-channel FET devices 125 allow charged signal in one of two storage capacitors to be amplified by the sense amplifier when either A or B signal is asserted high and LOAD signal 230 (terminals 110 in FIG. 1) is asserted high.

FET devices 125 also allow reading of stored charge on one of two capacitor storage cells. Reading is done by enabling device 125 and either device 130 or 135 to select the A or B capacitor, and by then also enabling device 120 after the sense amplifier has amplified the storage node charge signal.

Once the cross-couple sense-amplifier has had sufficient time to differentiate the signal, the clock signal 50 ($\phi_S$) for the N-channel devices 160 is asserted at a high value to resolve the differential input signal. At a later time, both P-channel devices 140 are turned on, which pulls the high input side to VDD. To reduce power dissipation, the P-channel devices 140 are turned off once the required voltage is attained. The LOAD signal remains asserted (370 in FIG. 2) until after the P-channel devices 140 are turned on. This allows the sense amplifier to refresh the selected A or B memory capacitor.

The same sense amplifier is also used to drive the data on the bit lines for read operations. Reading the stored pixel value requires the selection of one of two pixel values to be loaded into the sense amplifier and latched. Once the value is latched, the STORE line 220 is asserted high (320 in FIG. 2) to allow the data to be driven on the bit lines. The end of the bit line has another sense amplifier (not shown) to sense the data and to provide sufficient gain to latch the read data quickly.

Thus, in the embodiment of FIGS. 1 and 2, the first dynamic memory element includes a first storage capacitor A, the second dynamic memory element includes a second storage capacitor B, and data is stored selectively in a selected storage capacitor A or B in accordance with a capacitor selection signal. The sense amplifier refreshes data stored in the selected capacitor in accordance with the capacitor selection signal. Similarly, data is loaded to the MEMS device selectively from a selected one of the storage capacitors A or B in accordance with the capacitor selection signal. Thus, the sense amplifier is adapted to read data stored in a selected one of the storage capacitors A or B in accordance with a read signal. As described above, the read signal is sent by enabling device 125 and either device 130 or 135 to select the A or B capacitor, and by then also enabling device 120 after the sense amplifier has amplified the storage node charge signal.

Fabrication

A display using the present invention and having a desired number of pixels arranged in an array may be made by providing a substrate and forming an array of MEMS devices on the substrate, at least one MEMS device corresponding to each pixel. Each MEMS device of the array is configured to be actuated by an electrical signal on at least one actuation electrode. The fabrication also includes forming on the substrate a dynamic memory cell for each pixel, each dynamic memory cell including first and second dynamic memory elements, each including at least one capacitor, both of the first and second memory elements being electrically coupled to the actuation electrode of the MEMS device corresponding to a single pixel. Each dynamic memory cell that is formed also includes a sense amplifier configured to amplify the data signal and to latch data in response to a data signal and a clock signal. Forming the MEMS devices is accomplished using conventional MEMS processes well known to those skilled in the art, selecting those unit processes that are compatible with semiconductor processing of the dynamic memory elements. An example of such MEMS processes is the fabrication on the substrate of an array of digital micro-mirror devices, one or more digital micromirror devices corresponding to each pixel. The dynamic memory elements are formed by conventional semiconductor fabrication processes, such as conventional CMOS processes. Again, unit processes are chosen to be compatible with MEMS processing.

INDUSTRIAL APLICABILITY

Dynamic self-refreshing memory cells made in accordance with the present invention may be used for a variety of MEMS arrays, including arrays of digital micromirror display devices. Having more than one memory element per pixel reduces data bandwidth required for the MEMS devices, and the dynamic approach requires fewer transistors and thus smaller area than an equivalent two-memory conventional static approach. A local sense amplifier for each pixel allows refreshing of the selected pixel value and also allows driving the bit lines in read operations.

In accordance with a useful-aspect of the invention, a method is provided for using a dynamic memory cell in a display of the type having at least one MEMS device corresponding to each pixel: a dynamic memory cell is provided for each pixel, each dynamic memory cell including first and second dynamic memory elements, each of the first and second dynamic memory elements including at least one capacitor. Both of the first and second memory elements are electrically coupled to the MEMS device corresponding to a single pixel. A differential data signal, a clock signal, and a capacitor selection signal are provided to each dynamic memory cell. In response to the differential data signal, the capacitor selection signal, and a first phase of the clock signal, data is stored in at least one capacitor of a selected one of the dynamic memory elements. Data is stored in at least one capacitor, refreshed, and amplified. In response to the capacitor selection signal and a second phase of the clock signal, selected data is loaded to the MEMS device corresponding to each pixel to display information in accordance with the differential data signal. If desired, this method can also include reading the data stored. This method can reduce the bandwidth required for a memory cell having one memory element per pixel by about half if just two memory elements are used per pixel. If a number N of memory elements per pixel larger than two is used, the bandwidth requirement can be further reduced.

Although the foregoing has been a description and illustration of specific embodiments of the invention, various modifications and changes thereto can be made by persons skilled in the art without departing from the scope and spirit of the invention as defined by the following claims. For example, various MEMS devices, including both display devices and other (non-display) MEMS devices may be used with memory cells made in accordance with the invention, either individually or arranged in arrays, and other MOS or bipolar transistors or other active devices may be used in place of the CMOS devices used in the illustrated embodiments.

What is claimed is:

1. A memory cell for a display of the type having at least one MEMS device corresponding to each pixel, the memory cell storing data in response to a data signal and a clock signal, the memory cell comprising:

at least two independent dynamic memory elements per pixel, including first and second dynamic memory elements, each of the first and second dynamic memory elements including at least one capacitor, both of the first and second memory elements being electrically coupled to the MEMS device of a single pixel; and a sense amplifier configured to amplify the data signal and to latch data in response to the data signal and the clock signal, and wherein the sense amplifier refreshes data stored in the selected capacitor of the dynamic memory elements of each pixel, whereby the memory cell is a self-refreshing memory cell.

2. The memory cell of claim 1, wherein the at least two dynamic memory elements comprise N dynamic memory elements per pixel, where N is an integer equal to or greater than two.

3. The memory cell of claim 2, wherein N is an even number.

4. The memory cell of claim 2, wherein N equals two.

5. A memory for a display, the memory comprising a plurality of memory cells, at least one memory cell as recited in claim 1 for each pixel of the display.

6. A display device comprising the memory cell of claim 1.

7. An integrated circuit comprising the memory cell of claim 1.

8. A substrate carrying microelectronics comprising the memory cell of claim 1.

9. An electronic device comprising the memory cell of claim 1.

10. The memory cell of claim 1, wherein the at least one MEMS device comprises a micro-mirror device.

11. The memory cell of claim 1, wherein the data signal is provided as a differential signal including true and complementary data lines.

12. The memory cell of claim 1, wherein the sense amplifier amplifies the data signal to a predetermined level suitable for actuating the at least one MEMS device.

13. The memory cell of claim 12, wherein the predetermined level is suitable for actuating a micro-mirror device.

14. The memory cell of claim 1, wherein refreshing of the self refreshing memory cell of each pixel occurs without interference with simultaneous loading of data into memory cells of other pixels.

15. A memory cell for a display of the type having at least one MEMS device corresponding to each pixel, the memory cell storing data in response to a data signal and a clock signal, the memory cell comprising:

at least two dynamic memory elements per pixel, including first and second dynamic memory elements, wherein the first dynamic memory element includes a first storage capacitor, the second dynamic memory element includes a second storage capacitor, and data is stored selectively in a selected one of the first and second storage capacitors in accordance with a capacitor selection signal, both of the first and second memory elements being electrically coupled to the at least one MEMS device of a single pixel; and a sense amplifier configured to amplify the data signal and to latch data in response to the data signal and the clock signal, and wherein the sense amplifier is further configured to refresh data stored in a selected one of the first and second capacitors in accordance with the capacitor selection signal.

16. The memory cell of claim 15, wherein the at least two dynamic memory elements comprise N dynamic memory elements per pixel, where N is an integer equal to or greater than two.

17. The memory cell of claim 16, wherein the selective storing of data in a selected one of the first and second storage capacitors is characterized by a required bandwidth and the required bandwidth is about $\frac{1}{2}^{(N-1)}$ of the bandwidth required for a memory cell having one memory element per pixel.

18. A display device comprising the memory cell of claim 15.

19. An integrated circuit comprising the memory cell of claim 15.

20. A substrate carrying microelectronics comprising the memory cell of claim 15.

21. An electronic device comprising the memory cell of claim 15.

22. A memory cell for a display of the type having at least one MEMS device corresponding to each pixel, the memory cell storing data in response to a data signal and a clock signal, the memory cell comprising:

at least two dynamic memory elements per pixel, including first and second dynamic memory elements, wherein the first dynamic memory element includes a first storage capacitor, the second dynamic memory element includes a second storage capacitor, and data is loaded to the MEMS device selectively from a selected one of the first and second storage capacitors in accordance with a capacitor selection signal, both of the first and second memory elements being electrically coupled to the at least one MEMS device of a single pixel; and a sense amplifier configured to amplify the data signal and to latch data in response to the data signal and the clock signal; and wherein the sense amplifier is adapted to read data stored in a selected one of the first and second capacitors in accordance with a read signal.

23. The memory cell of claim 22, wherein the sense amplifier amplifies the data signal to a predetermined level suitable for actuating the at least one MEMS device.

24. A display device comprising the memory cell of claim 22.

25. A memory cell for a display of the type having at least one MEMS device corresponding to each pixel, the memory cell storing data in response to a differential data signal and a clock signal, the memory cell comprising:

first and second dynamic memory elements, both of the first and second memory elements being electrically coupled to a MEMS device corresponding to a single pixel, the first dynamic memory element including a first storage capacitor and the second dynamic memory element including a second storage capacitor, data being stored selectively in a selected one of the first and second storage capacitors in accordance with a capacitor selection signal at a first phase of the clock signal, and data being loaded to the MEMS device selectively from a selected one of the first and second storage capacitors in accordance with a capacitor selection signal at a second phase of the clock signal; and a sense amplifier configured to amplify the differential data signal to a predetermined level suitable for actuating the at least one MEMS device and to latch data in response to the differential data signal and the clock signal.

26. The memory cell of claim 25, wherein the sense amplifier is further configured to read, in response to a read signal, data stored in a selected one of the first and second capacitors.

27. The memory cell of claim 25, wherein the at least one MEMS device comprises a micro-mirror device and the predetermined level is suitable for actuating a micro-mirror device.

28. A method of using a dynamic memory cell in a display of the type having at least one MEMS device corresponding to each pixel, the method comprising the steps of:

a) providing a dynamic memory cell for each pixel, each dynamic memory cell having at least two dynamic memory elements per pixel, including first and second dynamic memory elements, each of the first and second dynamic memory elements including at least one capacitor;

b) electrically coupling both of the first and second memory elements to the at least one MEMS device corresponding to a single pixel;

c) providing a differential data signal, a clock signal, and a capacitor selection signal to each dynamic memory cell;

d) in response to the differential data signal, the capacitor selection signal, and a first phase of the clock signal, storing data in at least one capacitor of a selected one of the first and second dynamic memory elements;

e) refreshing and amplifying data stored in the at least one capacitor; and f) in response to the capacitor selection signal and a second phase of the clock signal, loading selected data to the at least one MEMS device corresponding to each pixel to display information in accordance with the differential data signal.

29. The method of claim 28, wherein the at least one MEMS device comprises a micro-mirror device.

30. The method of claim 28, further comprising the step of:

g) reading data stored in data-storing step d).

31. The method of claim 28, wherein the data-storing step d) is characterized by a required bandwidth and the required bandwidth is about half of that required for a memory cell having one memory element per pixel.

32. The method of claim 28, wherein each dynamic memory cell has a number N of dynamic memory elements per pixel, where N is an integer equal to or greater than two, and wherein the data-storing step d) is characterized by a required bandwidth and the required bandwidth is about $1/2^{(N-1)}$ of the bandwidth required for a memory cell having one memory element per pixel.

33. A display made in accordance with the method of claim 28.

* * * * *